US006656606B1

(12) United States Patent
Morin et al.

(10) Patent No.: US 6,656,606 B1
(45) Date of Patent: Dec. 2, 2003

(54) ELECTROPLATED ALUMINUM PARTS AND PROCESS OF PRODUCTION

(75) Inventors: Louis Charles Morin, Edmonton (CA); Angie Kathleen Molnar, Edmonton (CA)

(73) Assignee: The Westaim Corporation, Fort Saskatchewan (CA)

( * ) Notice: Subject to any disclaimer, the term of this patent is extended or adjusted under 35 U.S.C. 154(b) by 0 days.

(21) Appl. No.: 09/640,828

(22) Filed: Aug. 17, 2000

(51) Int. Cl.[7] ..... B32B 15/20

(52) U.S. Cl. ..... 428/652; 428/650; 428/935; 428/579; 40/27.5

(58) Field of Search ..... 428/935, 658, 428/650, 675, 652, 579, 680, 672, 673, 670; 40/27.5

(56) References Cited

U.S. PATENT DOCUMENTS

| | | | | |
|---|---|---|---|---|
| 61,143 | A | 1/1867 | Bernabé | 205/182 |
| 1,005,629 | A | 10/1911 | Fisher | 205/182 |
| 1,198,703 | A | 9/1916 | Cowper-Coles | 205/182 |
| 1,627,900 | A | 5/1927 | Hewitson | |
| 2,142,564 | A | 1/1939 | Korpiun | 91/68.2 |
| 2,320,998 | A | 6/1943 | Beebe | 154/2 |
| 2,418,265 | A | 4/1947 | Korpiun | 117/51 |
| 2,493,092 | A | 1/1950 | Stareck | 204/52 |
| 2,615,840 | A | 10/1952 | Chapman | 204/141 |
| 2,650,886 | A | 9/1953 | Zelley | 117/130 |
| 2,662,054 | A | 12/1953 | Passal | 204/33 |
| 2,676,916 | A | 4/1954 | Zelley | 204/33 |
| 2,709,847 | A | 6/1955 | Ihrie et al. | 29/195 |
| 2,745,799 | A | 5/1956 | Patrie | 204/38 |
| 2,746,136 | A | 5/1956 | Richaud | 29/197 |
| 2,801,213 | A | 7/1957 | Beuckman et al. | 204/32 |

(List continued on next page.)

FOREIGN PATENT DOCUMENTS

| | | | |
|---|---|---|---|
| CA | 390448 | 7/1940 | 117/77 |
| CA | 730602 | 3/1966 | 6/4 |

(List continued on next page.)

OTHER PUBLICATIONS

S. Wernick et al.: "Surface treatment and finishing of aluminum and its alloys", vol. 2, Ed. 5 1987, Finishing Publications, Teddington, GB XP002194803 155780, Chapter 14, p. 1026–p. 1050 No month.

(List continued on next page.)

*Primary Examiner*—John J. Zimmerman

(57) ABSTRACT

The invention provides a pretreatment process for electroplating aluminum parts or strip, in which the zincating solution is modified to improve the adhesion of the subsequent electroplate to the substrate. The aluminum part or strip, such as an aluminum coin blank or strip for coin blanks, is pretreated with an improved zincate solution which provides hydroxide ions in an amount in the range of 75–175 gpl, zinc ions in an amount in the range of 15–40 gpl, nickel ions in an amount in the range of 2–10 gpl and copper ions in an amount in the range of 1.5–5 gpl. The pretreatment process preferably includes a copper strike applied from a copper cyanide strike bath at a pH in the range of 8.5–9.5, using a current density in the range of 0.1–10 A/dm$^2$. The pretreatment and electroplating steps are preferably conducted by barrel plating, in accordance with another aspect of the invention. The invention also provides electroplated aluminum parts or strip, such as electroplated coin blanks, including a substrate formed from aluminum or an aluminum alloy and having multiple surfaces, a layer of zincate on at least one of the surfaces of the substrate and preferably completely encasing the substrate, a strike layer of a strike metal covering the layer of zincate, and one or more electroplated layers of one or more metals covering the strike layer, said one or more electroplated layers adhering to the substrate to withstand a deformation process without delamination from the substrate.

8 Claims, 1 Drawing Sheet

U.S. PATENT DOCUMENTS

| | | | | | |
|---|---|---|---|---|---|
| 2,814,590 | A | | 11/1957 | Portzer et al. | 204/52 |
| 2,872,346 | A | | 2/1959 | Miller | 117/65 |
| 2,885,331 | A | | 5/1959 | McLeod et al. | 204/52 |
| 2,938,841 | A | | 5/1960 | Dale | 204/32 |
| 3,030,282 | A | | 4/1962 | Passal | 204/52 |
| 3,108,006 | A | | 10/1963 | Kenedi et al. | 106/1 |
| 3,179,577 | A | | 4/1965 | Hadley | 204/52 |
| 3,216,835 | A | | 11/1965 | Saubestre | 106/1 |
| 3,235,404 | A | | 2/1966 | Mickelson et al. | 117/130 |
| 3,284,323 | A | | 11/1966 | Leloup | 205/185 |
| 3,607,147 | A | | 9/1971 | Harrison | 29/191 |
| 3,684,666 | A | | 8/1972 | Huntington et al. | 204/40 |
| 3,841,979 | A | | 10/1974 | Arcilesi | 204/38 |
| 3,841,982 | A | | 10/1974 | Yee | 204/55 |
| 3,881,999 | A | | 5/1975 | Toth et al. | 204/33 |
| 3,940,254 | A | | 2/1976 | McMullen et al. | 29/196.6 |
| 3,957,452 | A | | 5/1976 | Schaer et al. | 29/183.5 |
| 3,969,199 | A | | 7/1976 | Berdan et al. | 204/33 |
| 3,982,055 | A | | 9/1976 | Howard | 427/309 |
| 3,989,606 | A | | 11/1976 | Kampert | 204/33 |
| 4,013,492 | A | | 3/1977 | Rager et al. | 156/632 |
| 4,089,753 | A | | 5/1978 | McMullen et al. | 204/23 |
| 4,097,342 | A | | 6/1978 | Cooke et al. | 204/28 |
| 4,100,038 | A | | 7/1978 | Jongkind | 204/38 |
| 4,169,770 | A | | 10/1979 | Cooke et al. | 204/28 |
| 4,176,014 | A | | 11/1979 | Ruscoe et al. | 204/23 |
| 4,225,397 | A | | 9/1980 | Napier | 204/29 |
| 4,247,374 | A | | 1/1981 | Ruscoe et al. | 204/23 |
| 4,279,968 | A | | 7/1981 | Ruscoe et al. | 428/677 |
| 4,285,782 | A | | 8/1981 | Waldrop et al. | 204/32 |
| 4,292,377 | A | | 9/1981 | Petersen et al. | 428/675 |
| 4,330,599 | A | | 5/1982 | Winter et al. | 428/675 |
| 4,346,128 | A | | 8/1982 | Loch | 427/328 |
| 4,401,488 | A | | 8/1983 | Prinz et al. | 148/435 |
| 4,436,790 | A | | 3/1984 | Prinz et al. | 428/675 |
| 4,499,123 | A | | 2/1985 | Suzuki et al. | 427/282 |
| 4,551,184 | A | | 11/1985 | Bell et al. | 148/127 |
| 4,579,761 | A | | 4/1986 | Ruscoe et al. | 428/542.8 |
| 4,599,279 | A | | 7/1986 | Mirra et al. | 428/658 |
| 4,644,674 | A | | 2/1987 | Burrows et al. | 40/27.5 |
| 4,673,469 | A | | 6/1987 | Beach et al. | 204/38.4 |
| 4,715,116 | A | | 12/1987 | Thorpe et al. | 29/846 |
| 4,812,219 | A | | 3/1989 | Sattrup et al. | 101/375 |
| 4,861,442 | A | | 8/1989 | Tanaka et al. | 204/44.2 |
| 4,888,218 | A | | 12/1989 | Suzuki et al. | 427/383.9 |
| 4,894,125 | A | * | 1/1990 | Fenolia et al. | 126/624 |
| 4,904,354 | A | | 2/1990 | Stavitsky et al. | 204/40 |
| 5,014,774 | A | * | 5/1991 | Siak et al. | 165/133 |
| 5,085,744 | A | | 2/1992 | Brasch | 205/148 |
| 5,234,574 | A | | 8/1993 | Tsuji et al. | 205/213 |
| 5,246,565 | A | | 9/1993 | Mignardot | 205/181 |
| 5,459,103 | A | | 10/1995 | Kelleher et al. | 437/209 |
| 5,464,524 | A | | 11/1995 | Ogiwara et al. | 205/170 |
| 5,466,360 | A | | 11/1995 | Ehrsam et al. | 205/170 |
| 5,472,796 | A | | 12/1995 | Breedis et al. | 428/679 |
| 5,558,759 | A | | 9/1996 | Pudem | 205/50 |
| 5,607,570 | A | | 3/1997 | Rohbani | 205/297 |
| 5,712,049 | A | * | 1/1998 | Huhn et al. | 205/213 |
| 5,728,285 | A | | 3/1998 | Mathew | 205/182 |
| 5,730,851 | A | | 3/1998 | Arrowsmith et al. | 205/155 |
| 5,792,565 | A | | 8/1998 | Cupolo et al. | 428/670 |
| 5,843,538 | A | | 12/1998 | Ehrsam et al. | 427/601 |
| 6,054,037 | A | | 4/2000 | Martin | 205/295 |
| 6,068,938 | A | | 5/2000 | Kato et al. | 428/649 |
| 6,165,630 | A | * | 12/2000 | Gehlhaar et al. | 205/103 |

FOREIGN PATENT DOCUMENTS

| | | | | |
|---|---|---|---|---|
| CA | 753199 | | 2/1967 | 117/77 |
| CA | 1015905 | | 8/1977 | 204/21 |
| CA | 1093498 | | 1/1981 | B21J/1/02 |
| CA | 1101363 | | 5/1981 | C25D/7/00 |
| CA | 1105210 | | 7/1981 | B23P/3/00 |
| CA | 1198073 | | 12/1985 | C25D/5/34 |
| CA | 1204969 | | 5/1986 | 117/77 |
| CA | 1219708 | | 3/1987 | B23K/20/00 |
| CA | 2013639 | | 6/1998 | C25D/3/58 |
| EP | 0 498 436 | A2 | 2/1992 | C25D/5/44 |
| EP | 592946 | A1 | 7/1993 | C23C/28/02 |
| GB | 626693 | | 7/1949 | |
| GB | 1007252 | | 10/1965 | |
| GB | 1015563 | | 1/1966 | |
| GB | 1276272 | | 6/1972 | A44C/21/00 |
| GB | 2272001 | A | 4/1994 | C25D/5/34 |
| JP | 4-327878 | | 11/1992 | A63F/9/00 |
| JP | 4-369793 | | 12/1992 | G07F/1/06 |
| JP | 5-35963 | | 2/1993 | G07F/1/06 |
| WO | WO 99/58256 | | 11/1999 | B05D/5/04 |

OTHER PUBLICATIONS

IBM Technical Disclosure Bulletin, Jan. 1967, "Nickel Plating Directly onto Aluminum", pp 961–962.

IBM Technical Disclosure Bulletin, Mar. 1976, "Nickel or Copper Strike Electroplating Bath for Zincated Aluminum", p3414.

IBM Technical Disclosure Bulletin, Dec. 1987, "Ultra Clean Aluminum Surface by Vaporizing off a Chemical Film in a Vacuum", pub no 284.

The American Society for Testing and Materials, "Standard Guide for Preparation of Aluminum Alloys for Electroplating", Annual Book of ASTM Standards, B 253–87, Global Engineering Documents, Jul. 1987.

Brenner, A., "Electrodeposition of Alloys—Priniciples & Practice", vol. II, National Bereau of Standards, Washington D.C., chapters 13 to 16, pp 989 to 1083, (no date).

China Mint Company, 1991 "Aluminum and its Alloys as Coinage Materials, Aspects of Material Evaluation and Selection", Nov. 20, 1991 pp 141–163.

Golby, J.W., Dennis, J.K. and Wyszynski, A.E., 1981, "Factors Influencing the Growth of Zince Immersion Deposits on Aluminum Alloys", Transactions of the Institute of Metal Finishing, (no month) 1981, Vol 59, pp17–24.

Golby, J.W. and Dennis, J.K., 1980, "A Study of the Effect of Pretreatment Procedures on the Plating of Aluminum Alloys", Surface Technology, 12 (no month) (1981) pp 141–155.

Graves, B. A., "Plating of Aluminum Alloy Wheels", Automotive Finishing Online, 3pp from website www.afonline.com, printed Feb. 29, 2000.

Institute of Advanced Manufacturing Sciences, 1999, "Zincate Immersion Coating", 2 pp from website www.iams.org, printed Feb. 29, 2000.

Itoh,H, "Pretreating Method of Low–purity Aluminum Alloy Plating", Database 2000 Cambridge Scientific Abs, 797715 199704–P7–0148.

Khudenko, B.M. and Gould, J.P., (no month) (1991), "Specifics of Cementation Processes for Metals Removal", Wat. Sci. Tech. Vol 24, No. 7, pp 235–246, 1991, Great Britain.

Levinson, D.W. and Mondolfo, L.F., 1966, "Electroplating on Aluminum alloys", Plating, Aug. 1966, pp986–990.

Monteiro, F.J., Barbosa, M.A., Ross D.H. and Gabe D.R., (no month) 1991, "Pretreatments to Improve the Adhesion of Electrodeposits on Aluminum".

Surface and Interface Analysis, Vol 17 pp 519–528, (no month) (1991), John Wiley & Sons, Ltd.

Okuda, Yukio, "Aluminum as Coinage Material, the Process of Coin–Manufacture", Researcher Operations Control Department, Mint Bureau Ministry of Finance, Japan, pp 165–177 (no date).
Pearson, T. and Wake, S.J., "Improvements in the Pretreatment of Aluminum as a Substrate for Electrodeposition", Transactions IMF, (no month) 1997, 75(3) pp 93–97.
Sallee, N., Cromer, M. and Vittori, O., (no month) 1993, "Electroplating of Copper on Aluminum With Direct and Pulsed Currents", Canadian Metallurgy Quarterly, Vol 32, No 2, pp 155–162, 1994, Canadian Institute of Mining and Metallurgy, 0008–4433(93)E0014–V.
Secretariat for Aluminum and Environment, "Which Alloys are Suitable for Plating?", Alubook, Topic 14034, 2pp from website www.alu–info.dk, printed Feb. 29, 2000.
Secretariat for Aluminum and Environment, "Pre–Treatment by Zincating", Alubook, Topic 14037, 2pp from website www.alu–info.dk, printed Apr. 6, 1998.
Schaer, G., 1981, "Adherent Zinc Alloy and Copper Plates on Aluminum", Plating and Surface Finishing, Mar. 1981.
Shapiro, H., 1967, "Electroplating Aluminum—A Controllable Process", Metal Finishing, Feb. 1967, pp 58–61.
Smith, H. and Snyder, D., "Developments in Aluminum Wheel Plating, Plating Aluminum Wheels as Well as Getting the "Look" of Aluminum has Changed . . . ", Pfonline, online article, 4 pp from www.pfonline.com, printed Feb. 16, 2000.
Such, T.E. and Wyszynski, A.E., 1965, "An Improvement in the Zincate Method for Plating Aluminum", Plating, Oct. 1965, pp 1027–1034.
Van de Berg, J.F.M., van Dijk, G.A.R. and van de Leest, R.E., 1985, "Room Temperature Electroplating of Aluminum", Metal Finishing, May 1985, pp 15–18.
Wyszynski, A.E., 1967, "An Immersion Alloy Pretreatment for Electroplating on Aluminum", Transactions of the Institute of Metal Finishing, (no month) 1967, Vol 45, pp 147–154.
Wyszynski, A.E., (no month) 1980, "Electrodeposition on Aluminum Alloys", Transactions of the Institute of Metal Finishing, 1980 Vol 58, pp34–40.
Zelley, W.G., 1974, "Plating on Aluminum", Modern Electroplating, 3rd ed., edited by F.A. Lowenheim, Wiley–Interscience, NY, ch. 24, pp 556–563.

* cited by examiner

ELECTROPLATED ALUMINUM PARTS AND PROCESS OF PRODUCTION

FIELD OF THE INVENTION

This invention relates to process for the electroplating of aluminum parts, including the electroplating of coinage blanks. The invention also extends to electroplated aluminum parts, including coinage products.

BACKGROUND OF THE INVENTION

Electroplating of aluminum or aluminum alloy substrates is more difficult than on many other materials because an oxide film coats aluminum immediately when exposed to air or water. This oxide film results in uneven deposition of electroplates, and poor adhesion of the plate. Several approaches exist for the pretreatment of aluminum and aluminum alloys substrates for electroplating. These include a) etching, in which the substrate is pitted with an attacking solution, b) anodizing, in which an oxide film is thickened by anodizing and then etched to roughen the surface; c) electroless nickel plating, in which nickel is deposited from solution without the use of an applied current, and d) precoating, in which the oxide film is first removed with cleaners or acid, and then immediately coated with tin or zinc, more typically zinc, by immersion deposition. When zinc is used, this precoating process is known as zincating, the immersion solution is termed a zincate or zincating solution, and the coating is often termed a zincate coating or zincate layer.

Kodak developed and patented zincating solutions in about 1927. It was a simple solution of sodium hydroxide and zinc chloride. Later, in 1953, W. G. Zelley proposed three zincating solutions that are referred to as "simple" zincating solutions. The three "simple" zincating solutions, together with typical substrate cleaning, conditioning, and post-zincating strike-layers, are discussed in ASTM B253-87 "Preparation of Aluminum Alloys for Electroplating." The drawbacks of the simple zincating solutions were that they had to be operated differently for different aluminum alloys and that the adhesion of the electroplated layer to the aluminum was inconsistent. Subsequent improvements to zincating aluminum included using zincate solutions containing elements such as copper, nickel and iron, with complexing agents such as cyanide and tartrate, to keep the metals in solution, and double dipping in which a first zincate immersion coating was stripped off in a suitable acid prior to forming a second zincate immersion coating.

In the 1960's, W. Canning Ltd. developed a Modified Alloy Zincate (MAZ) solution. This solution was designed to generate improved adhesion over the simple zincating solutions, to eliminate the need for depositing intermediate strike layers of metals such as copper, brass or nickel prior to electroplating, and to produce more consistent process results. Included in the preferred MAZ solution besides zinc, were the additional metals of copper, nickel and iron. This work is referred in Great Britain Patent 1,007,252, granted in 1965.

In spite of many advances made in the electroplating of aluminum and its alloys, adhesion of the electroplate to the substrate still continues to be a problem. While a weakly adherent electroplated layer may suffice for applications in which the final product is primarily aesthetic, many practical applications demand good adhesion of the electroplated layers to the underlying aluminum substrate.

A particularly difficult environment for electroplated products is circulation coinage. Today, many countries of the world rely on plated coinage in which coinage metals, such as nickel, copper, bronze or brass overlayers are electroplated onto cores of coinage metals such as zinc, steel, or nickel. Processes of electroplating such coinage cores have been developed to ensure that a highly-adherent electroplated layer is formed which can withstand a bend test. The bend test is one indication of whether the plated coinage product can withstand the rigors of a deforming process, that is a minting step, without delamination of the electroplated layers from the substrate. While bend tests may vary, in general, to pass such a test for circulation coinage, the plated coin blank is bent through a 90° angle and the plated layer must not be removable with a sharp instrument such as a file or knife. Although aluminum and its alloys have been used in coins, to the inventors' knowledge, no electroplated circulation coinage products with aluminum or aluminum alloy cores exist in the world today. Efforts by the inventors to apply a simple zincating solution, or an MAZ solution to aluminum substrates, as set out in the Examples of this application, failed to produce adequate adhesion to pass a bend test.

Japanese Patent Application JP 19910146184, published as JP 4369793 on Dec. 22, 1992, to Yagiken, K K and others, describes gaming tokens produced from aluminum or its alloys to include a colored anodized layer and zinc nickeling or zinc-nickel-chrome plating. Japanese Patent Application JP 19910187628, published as JP 5035963 on Feb. 12, 1993, to Yagiken, K K and others, also discusses game machine tokens and their manufacture. This latter reference uses a zincating procedure to coat aluminum blanks that are used for game machines. The zincate referred to in this patent is Substar™ ZN-111 manufactured by Okuno Reagent Industry of Japan. There is no indication in the reference that the tokens are minted after plating. Efforts by the inventors to duplicate the process of this Japanese reference, as set out in the Examples of this application, failed to produce a coinage product with sufficient adhesion of the plate to function as a circulation coin.

There is still a need for an effective aluminum pretreatment process for the electroplating of aluminum parts, which results in a plate with sufficient adhesion to withstand the rigors of a deformation process. There is a particular need, for coinage purposes, of an aluminum pretreatment and electroplating process which will produce a plated coinage product which can withstand a bend test without causing delamination of the electroplated layers from the underlying substrate.

SUMMARY OF THE INVENTION

The present invention provides both an improved zincating and an improved copper strike process for the pretreatment of substrates of aluminum and its alloys, such that subsequent electroplating layers are sufficiently adherent so as to withstand a deformation process without causing delamination of the electroplated layers from the substrate. In a preferred embodiment, the pretreatment processes of this invention are capable of producing electroplated products which meet the rigorous adhesion requirements of the circulation coinage industry and allow for the mass production of small barrel electroplated parts such as coinage blanks. The process has been demonstrated to produce electroplated coin blanks with very good adhesion of several different electroplated layers to the aluminum substrate, and to allow a strike of the zincated aluminum coin blanks at practical current densities for barrel electroplating.

The improved copper strike process of this invention has the advantage of operating at realistic and efficient current densities for barrel plating. Standard electroplating barrels are limited to currents of about 1000 Amps, and a typical operational current density in manufacturing is approximately 0.25 $A/dm^2$, bases on total area of the charge. The literature relating to plating aluminum refers to current densities from 2.5 $A/dm^2$ to 40 $A/dm^2$. As the standard electroplating barrel establishes a total current limitation of about 1000 Amps, the only method of increasing the current density is by reducing the area of the quality of parts that are in the barrel. Reducing the loading of the barrel translates into a loss of manufacturing productivity in barrel electroplating.

In developing the process of this invention, the inventors determined that simple zincating solutions, together with those developed as MAZ and Substar™ (as referred to above), were inadequate to meet the manufacturing and quality requirements for electroplated coinage. In particular these prior are zincating processes did not produce a plated coin blank which could withstand a bend test, which is a standard known in the coinage industry. The first attempt at producing barrel electroplated aluminum coinage was a zincating solution composed of the following components: 500 gpl NaOH, 100 gpl ZnO, and 2 gpl $FeCl_3$. The blanks were coated with zinc using a two step zincating process. Following a copper strike and electroplating, the blanks were subjected to the bend test, and according to the ASTM bend test standard, the blanks failed the test. The coating cracked along the bend, and it was possible to peel off the coating with the fingers.

As an alternative, a more dilute simple zincate bath was tested by the inventors, and the electroplated aluminum blanks exhibited similarly poor results in the bend test. This zincating solution had a composition of 100 gpl NaOH, 20 gpl ZnO, and 2 gpl $FeCl_3$. The aluminum blanks were zincated in a two step zincated in a two step zincating process, placed in a standard high current density copper strike bath, and then electroplated in standard copper cyanide electroplating solution. After this process, individual blanks were bent to check the adhesion of the coating to the aluminum. It was possible to remove the coating with the fingers following the test.

In another attempt to improve the adhesion of the electroplated layer, the inventors tried a Modified Alloy Zincate (MAZ) solution from British Patent 1,007,252. This zincating bath had a composition of NaOH of 106 gpl, zinc sulfate 40 gpl, nickel sulfate hexahydrate 30 gpl, zinc sulfate heptahydrate 40 gpl, potassium hydrogen tartrate 50 gpl, and copper sulfate pentahydrate. The adhesion of the subsequent electroplate, even when a copper strike was included, was not adequate for circulation purposes because following the bend test it was still possible to remove the electroplated coating using a sharp instrument.

The best adhesion of the electroplated coating to the aluminum, as demonstrated by a standard bend test, and the most consistent results were achieved by using both the improved zincating process and the copper strike process developed by the inventors. A two-step zincate process was used where the composition of the zincate bath was 273 gpl NaOH, 24 glp $NiSO_46H_2O$, 8.7 gpl $CuSO_45H_2O$, 40 gpl $ZnSO_47H_2O$, 1.7 gpl iron chloride, and a complexing agent to keep the ions in solution. The copper strike had a free cyanide composition of 15 gpl, the copper cyanide was 30 gpl, and the pH was 8.5. The copper strike could be operated at a wide variety of current densities ranging from 0.10 $A/dm^2$ and upwards. After the bend test, the coating was still very strongly adhered to the blanks and it was not possible to remove the coating using a sharp instrument.

In one broad aspect, the invention provides an improvement in a process for electroplating aluminum parts or aluminum strip, in which the aluminum part or strip is pretreated with a zincate solution containing the ions of hydroxide, zinc, nickel and copper. In accordance with the present invention, the improvement comprises providing the zincate solution so as to produce hydroxide ions in an amount in the range of 75–175 gpl, zinc ions in an amount in the range of 15–40 gpl, nickel ions in an amount in the range of 2–10 gpl and copper ions in an amount in the range of 1.5–5 gpl. Most preferably, the improved process also includes applying a strike layer of a coinage metal, preferably copper or nickel, to the aluminum part or strip after zincating. Most preferably the strike layer is copper, applied from a copper cyanide strike bath at a pH in the range of 8.5–9.0, using a current density in the range of 0.1–10 $A/dm^2$.

In another broad aspect, the invention provides a method of electroplating pre-cleaned aluminum parts, comprising:

a) loading the pre-cleaned aluminum parts into a perforated electroplating barrel;

b) immersing the barrel into a zincate solution to submerge the aluminum parts, and tumbling the aluminum parts in the barrel to form a first zincate layer on the aluminum parts, the zincate solution containing hydroxide ions in an amount in the range of 75 to 175 gpl, zinc ions in an amount in the range of 15 to 40 gpl, nickel ions in an amount in the range of 2 to 10 gpl, and copper ions in an amount in the range of 1.5 to 5 gpl;

c) immersing the barrel into an acid solution to submerge the aluminum parts and to strip the first zincate layer;

d) immersing the barrel in a zincate solution having a composition as set forth in step (b), to submerge the aluminum parts, and tumbling the aluminum parts in the barrel to form a second zincate layer which completely covers the aluminum parts;

e) immersing the barrel in a strike bath of a strike metal, to submerge the aluminum parts, and tumbling the aluminum parts in the barrel while applying an electrical current to the aluminum parts in the barrel, to apply a strike layer of the strike metal to the aluminum parts;

f) immersing the barrel in one or more electroplating baths of one or more metals, to submerge the aluminum parts, and tumbling the aluminum parts in the barrel while applying an electrical current to the aluminum parts in the barrel, to apply one or more electroplated layers of the one or more metals or of an alloy of the metals to the aluminum parts; and g) removing the electroplated aluminum parts from the barrel.

In yet another broad aspect, the invention provides an electroplated aluminum part or strip, comprising:

a substrate formed from aluminum or an aluminum alloy and having multiple surfaces;

a layer of zincate on at least one of the surfaces of the substrate;

a strike layer of a strike metal covering the layer of zincate; and one or more electroplated layers of one or more metals covering the strike layer, said one or more electroplated layers adhering to the substrate to withstand a deformation process without delamination from the substrate.

In preferred embodiments, the electroplated aluminum parts of this invention comprise electroplated coin blanks, in which the strike metal is preferably copper or nickel, most preferably copper, and wherein the one or more electroplated layers is composed of one or more of coinage metals or alloys, preferably selected to provide one or more electroplated layers of one or more of nickel, copper, bronze, brass, silver, gold, platinum and alloys thereof. The electroplated coin blanks of this invention have been proven to provide adhesion of the electroplated layer(s) to the substrate sufficient to withstand a minting step, or a bend test, making them suitable for circulation coinage.

By "strike metal" as used herein and in the claims is meant any metals capable of being plated by electroplating or electroless plating to provide a thin adherent layer of the metal.

By "deformation" as used herein and in the claims is meant plastic deformation of a metal, in which the volume and mass of the metal are conversed and the metal is displaced from one location to another. Deformation processes include forging, rolling, wire drawing, extrusion, deep drawing, stretch forming, bending, and shearing. Minting is an example of a forging step.

By "mintable" as used herein and in the claims is meant that a coinage blank has the following characteristics: sufficiently soft to take an impression on striking (generally about 0.02 mm to 5 mm relief detail with practical loads on commercial minting presses); having a electroplate with a fine grain size to permit complete filling of the minting die and uniform metal flow; having a controlled surface finish after minting, such as frosted, glossy and/or matte; and having friction and flow characteristics in the minting dies such that acceptably long minting die lives can be obtained.

DESCRIPTION OF THE DRAWING

The FIGURE is a schematic flow sheet of the preferred aluminum pretreatment, strike and plating processes of this invention.

DETAILED DESCRIPTION OF THE PREFERRED EMBODIMENT

Figure 1:
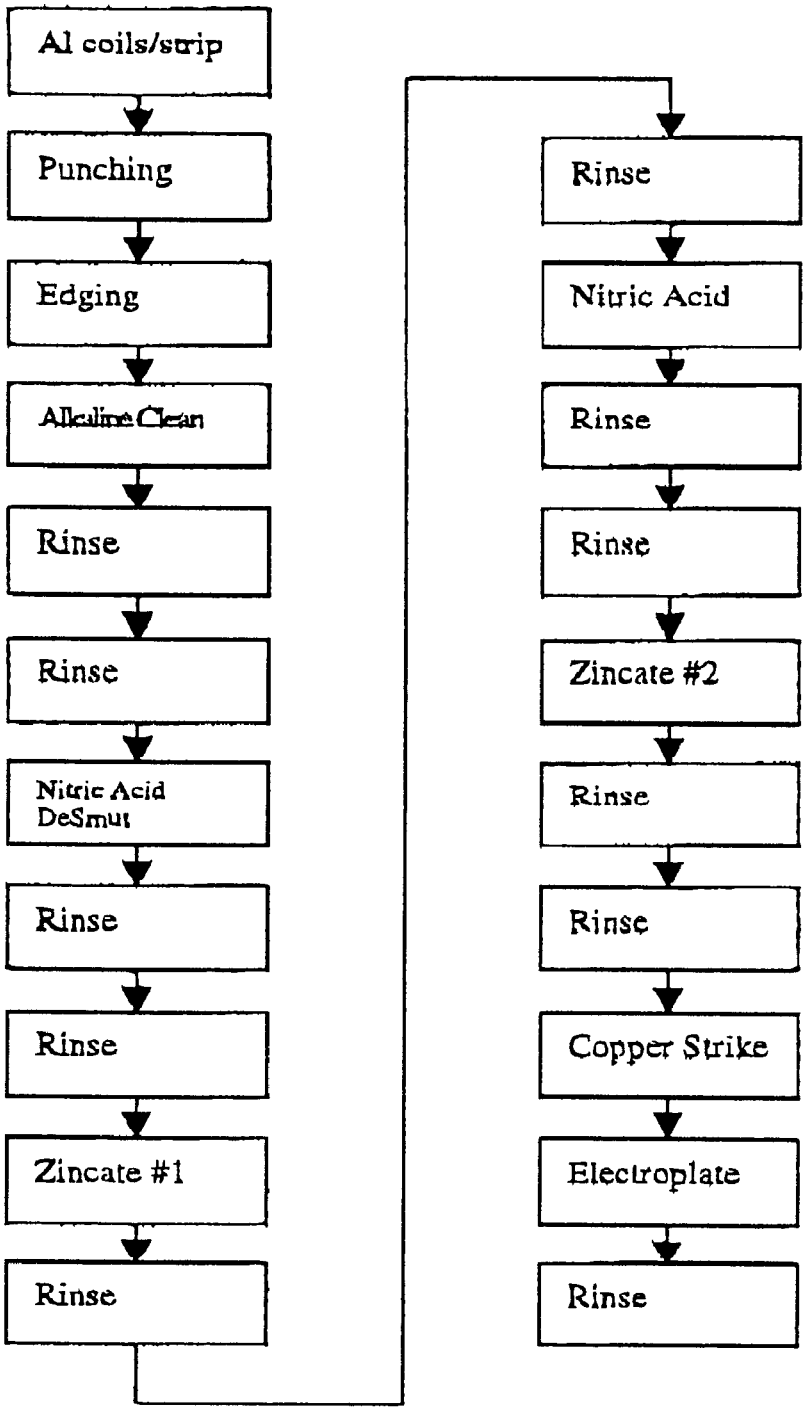

The electroplating of aluminum is used for a wide variety of applications. Cooper-nickel-chromium, copper-silver, copper-silver-rhodium, and copper-nickel rhodium coatings are used in indoor or light outdoor decorative applications. Cadmium coatings are used for corrosion resistance. Chromium, copper-nickel-chromium, and copper-nickel electroplated coatings are used for applications requiring wear resistance. Chromium, copper-nickel-chromium, and copper-nickel is used in applications requiring wear resistance and for improved sliding properties. Tin, copper-tin-lead, copper-nickel, and copper is electroplated for improved solderability. Finally, a copper-silver coating is used on aluminum to provide improved electrical contact. The aluminum pretreatment processes of the present invention have application in a wide variety of aluminum plating applications, such as set out above, and can be used on a wide range of aluminum or aluminum alloy products. For ease of description, the process is set out herein in association with the electroplating of circulation coinage by barrel plating, in which aluminum parts are electroplated in electroplating barrels, which may be of any of the known types, including oscillating, rotating, oblique or cluster barrels, all of which impart a tumbling action to the barrel contents, with coinage metals such as copper, nickel, bronze, brass, silver, gold and platinum, in one or more layers. However, it should be understood that the aluminum pretreatment processes of this invention are applicable to the plating of other aluminum parts, whether by barrel plating or by other electroplating techniques such as rack plating or the plating of strips, including the continuous plating of strip supplied in coils.

Generally, a barrel electroplating line includes the following known components:

1. One or more electroplating barrels, which generally consist of a perforated cylinder adapted to rotate about its axis, and equipped with a means to impart a current to the load, such as cable danglers or a conducting plate at the barrel end(s).
2. Support Structure to suspend the one or more electroplating barrels.
3. One or more treatment tanks containing the such treatments as rinse solution, degreasing solution, acid stripping solution, zincate solution and electroplating solutions. The tanks holding the electroplating solutions are equipped with anode rods with anodes, barrel supports, motors for barrel rotation (if not carried on the barrels), and electrical circuit means to connect the anode and cathode to the source of current so as to place an electrical potential across the electrolyte solution in a manner to cause electroplating of the parts in the barrel, when the barrel is at least partially submerged in the electrolyte solution.
4. Gearing to transmit mechanical power to the electroplating barrel to provide rotation about its axis.
5. Rectifier and contacts to transfer the current from the rectifiers to the current carrying components of the barrel.
6. Hoist system (automatic or manual) to move the barrel sequentially through each stage of the process, through a series of horizontal and vertical movements.

The process is adaptable to a wide range of aluminum or aluminum alloys, including both wrought and cast alloys. The aluminum substrate, a coin blank in the case of coinage products, may be made from a wide range of aluminum or aluminum alloys. Exemplary wrought alloys are from the 1XXX pure aluminum series, the 2XXX aluminum-copper series, the 3XXX aluminum-manganese alloys, the 4XXX aluminum-silicon alloys, the 5XXX aluminum-magnesium alloys, the 6XXX which are the aluminum-magnesium-silicon alloys, or 7XXX which are the aluminum-zinc series alloys. Common examples of wrought aluminum alloys include 1000, 1010, 1080, 2024, 3003, 3105, 5052, 5056, 6061, 7075. Exemplary cast alloys are the 1XX or almost pure aluminum, the 2XX or aluminum-copper alloys, the 3XX aluminum-silicon-magnesium, aluminum-silicon-copper, or the aluminum-silicon-copper-magnesium alloys, the 4XX aluminum-silicon alloys, the 5XX aluminum-magnesium alloys, the 7XX aluminum-zinc alloys, and the 8XX aluminum-tin alloys.

The most preferred list of wrought alloys for the production of coinage includes alloys from the 1XXX, 3XXX and 5XXX series of alloys. Preferred examples include 1100, 3003, 3105, 5052 and 5056 type aluminum alloys.

The process of the present invention is described below as a barrel plating process for circulation coinage, with reference to the schematic flow sheet of the Figure, but may be conducted with other aluminum parts by barrel or rack plating, within the scope of the present invention.

The starting point for the production of electroplated aluminum or aluminum alloy coinage blanks is aluminum strip. Particularly preferred for coinage is aluminum strip that is purchased in coil form that is suitable for punching using standard industrial punch presses. The punch press uses a series of punches and dies arranged in a pattern to produce circular discs call punched coin blanks, cores or substrates.

Following the punching operation, the punched blanks are usually rimmed using a coin rimming machine, as is known in the coinage industry. The machine operates automatically, with the blanks being fed firstly, into a grooved wheel using a vibratory feeder, the controls the feed rate, and then into a segment that reduces the diameter and upsets a rim onto the blank. Alternatively and/or in addition, the rimming operation can be performed after plating.

After blanking, and rimming, the blanks are transferred to the pre-treatment and electroplating process of this invention, by loading the edged blanks into an electroplating barrel. The process of this invention has the advantage that the blanks can remain in the barrel throughout the pre-treatment and electroplating steps of this invention, without the need of removal, adding to the ease of processing.

The pretreatment and electroplating process is subdivided into a series of steps of cleaning, acid etch, zincating, copper strike, and electroplating. The pre-treatment and electroplating part of the process uses a standard barrel electroplating line known in plating coinage, with additional tanks to accommodate the additional steps required to electroplate aluminum.

The first pre-treatment step is to clean the aluminum blanks of any dirt, grease or oil, using any standard aluminum cleaner, such as an alkaline cleaner, in order to form a pre-cleaned aluminum part. This step is performed to obtain a consistent and uniform deposit by producing a clean active surface. One preferred cleaner is Oakite™ Aluminum Cleaner 164 available from Oakite Products Inc. of Berkely Heights, N.J. Oakite Aluminum Cleaner 164 is a solid with the following composition: 25%–35% by weight sodium carbonate, 20%–30% trisodium phosphate, 15%–25% tetrasodium pyrophosphate, 10%–20% sodium metasilicate, and less than 10% sodium silicate. Other exemplary cleaners include a solution of 23 gpl sodium carbonate and 23 gpl trisodium phosphate. The Oakite cleaner is preferably mixed to concentration of between 45 and 75 gpl, and generally in the 60 gpl range. The blanks inside the barrel may be placed into the bath for 5 minutes at a temperature of 60° C. to remove any dirt, grime, or oils from the surface of the aluminum. After the cleaning, the blanks are preferably rinsed in two separate steps for 2 minutes each in deionized water.

Following the rinsing, the blanks and barrel are immersed in acid, such as 50% nitric acid, to de-smut the blanks. Desmutting is a process whereby excess grime is removed from the surface of the aluminum. This step is also preferably followed by a two step rinse step where the blanks are rinsed in deionized water in each step for 2 minutes.

The next step is to apply a first zinc-nickel-copper (zincate) coating to the surface of the aluminum blanks. The coating is applied by using a zincate-type bath. A preferred composition of the zincate bath is as follows (with gpl referring to grams per liter):

250 to 300 gpl NaOH
24–80 gpl $NiSO_46H_2O$
8.0–12.0 gpl $CuSO_45H_2O$
40.0–60.0 gpl $ZnSO_4$
40.0–60.0 gpl $ZnSO_47H_2O$
60 gpl potassium hydrogen tartrate
1.0–3.0 gpl iron chloride: and optionally
0.0%–0.5% Rexonic™ wetting agent.

Rexonic wetting agent is a surfactant with the composition of ethoxylated alcohols, C9–C11. The wetting agent may be added to prevent any bubbles from reaction adhering to the surface and interfering with the immersion reaction. Rexonic is sold under the trade name Rexonic N91-8 by Huntsman Corporation of Guelph, Ontario, Canada. Other wetting agents known in electroplating may also be used.

The edged blanks in the barrel are preferably immersed into this solution for 1 minute at a temperature of 45° C. Excess zincate solution is removed from the surface of the blanks, preferably by two 2-minute rinse steps in deionized water.

The next step is to remove the first zinc-nickel-copper coating using room temperature nitric acid. The concentration of the nitric acid is preferably 50% by volume. The zinc-nickel-copper coated pieces inside the barrel are briefly immersed into this nitric acid bath, for example for 15 seconds. A range of 5 seconds to 2 minutes is acceptable. To prevent any contamination of subsequent baths, the parts inside the barrel are rinsed in two steps for 2 minutes each.

After the rinse steps, the blanks are again immersed into a zincate bath of the same composition as set forth above, and which may be the same solution as used in the first zincating step, for a brief period of about 15 seconds, in order to obtain complete coverage of the blank. This process is referred to as the second zincate step. Following the second zincate step, the blanks are rinsed in two separate tanks for 2 minutes each.

With the zinc-nickel-copper coating firmly applied, the next step is to perform a thin strike of a suitable coinage metal, such as copper or nickel. There are a large number of strikes available, including standard copper cyanide solution, neutral nickel strike treatment electrolyte, a nickel glycolyte strike, and electroless nickel solution, and a copper pyrophosphate solution. The preferred strike bath composition has a copper cyanide strike solution, having a free cyanide concentration of 25 gpl, and a copper cyanide concentration of 35 gpl. The pH of this bath is preferably about 9.0. The pH is lowered below the range of a normal copper strike bath in the reported literature, so that the copper strike bath can be operated at lower current densities. The current densities preferably range between 0.1 $A/dm^2$ and 2.5 $A/dm^2$, calculated based on the total area of the load in the barrel.

As mentioned above, the current density is much lower in the copper strike process of this invention than is used in "standard" copper strike electroplating baths. This is very important for barrel electroplating applications. A high current density effectively reduces the total charge because standard electroplating barrels are limited to 1,000 amps. For example, steel substrates are normally barrel electroplated at current densities of 0.25 $A/dm^2$; however, a standard copper strike solution for aluminum is reported by the prior art as requiring a current density of 2.5 $A/dm^2$. The higher current density effectively reduces the charge by 90%, which dramatically lowers productivity. The low current density copper strike enables barrel electroplating of aluminum at practical production quantities.

Another advantage of the copper strike process of this invention is that "live-entry" is not required. "Live entry" is the application of current prior to entry into the electroplating bath. This is a complicated step that is difficult to perform in the constraints of a production environment, so the avoidance of a live entry plating process represents a significant cost saving.

In Tables 1 and 2, the preferred operating parameters of the process of the present invention are set forth. In Table 1, the most important ionic species of the zincating bath are set forth in their preferred ranges. For comparison purposes, Table 1 includes the preferred range of the ionic species set forth in prior art patent UK Patent 1 007 252 (Example 2, Table 2). In Table 2 below, the operating parameters of the copper strike process are set forth. The current density is set forth herein and in the claims using a calculation based on the total area of the load in the barrel.

TABLE 1

Preferred Zincating Bath Composition

| Ionic Species in Zincate Bath | Operative Range (gpl) | Preferred Range (gpl) | Most Preferred (gpl) | Comparison to UK 1 007 252 |
|---|---|---|---|---|
| $OH^-$ | 75.0–175.0 | 89.0–118.0 | 100.0 | 43.8–48.9 |
| $Zn^{2+}$ | 15.0–40.0 | 19.2–23.7 | 20.2 | 10.2–12.2 |
| $Ni^{2+}$ | 2.0–10.0 | 2.5–6.9 | 4.5 | 5.6–6.7 |
| $Cu^{2+}$ | 1.5–5.0 | 2.2–2.6 | 2.4 | 0 or 1.3 |
| $Fe^{3+}$ | 0.1–1.0 | 0.15–0.62 | 0.5 | 0 or 0.7 |

TABLE 2

Preferred Copper Strike Parameters

| Parameter | Operative Range | Preferred Range | Most Preferred |
|---|---|---|---|
| pH | 8.5–9.5 | 8.5–9.5 | 8.5–9.0 |
| $Cu^{2+}$gpl | 10.0–50.0 | 25.0–45.0 | 40.0 |
| Free CN · gpl | 30–35.0 | 5.0–25.0 | 5.0–25.0 |
| Current Density (A/dm$^2$) | 0.1–10.0 | 0.25–2.5 | 0.25 |

After the strike, the aluminum parts inside the barrel can be electroplated with one or more layers of one or more coinage metals, to provide electroplated layers such as nickel, copper, bronze, brass, silver, gold and platinum, as is well known in the coinage industry. The process of the present invention has been demonstrated with five different, and exemplary electroplating baths, including a copper cyanide bath, a modified copper cyanide bath with brighteners, a copper cyanide and potassium stannate bronze electroplating bath, a copper and zinc cyanide brass electroplating bath, and a nickel sulphamate electroplating bath. Electroplating baths can be modified by additives known in electroplating, such as wetting agents, levellers and brightener. Exemplary electroplating conditions are set out below.

For a final copper plated part, after the strike, the blanks are transferred into a standard potassium cyanide copper electroplating bath. The copper concentration is about 32 gpl, but may range between 20 and 45 gpl. The free potassium cyanide concentration is about 15 gpl, but can range between 10 and 20 gpl. The potassium hydroxide concentration is about 15 gpl, but can range between 10 and 20 gpl. The blanks are plated at a current density of about 0.10 A/dm$^2$ for 5 hours.

In order to produce a white or silver colored part, the blanks are immersed in a nickel sulphamate electroplating bath. The pH of the nickel plating bath is about 2.35, the boric acid concentration is about 42.2 gpl, the surface tension is about 37.6 dynes/cm$^2$, and the nickel concentration is about 113 gpl.

For a yellow colored part, a choice can be made between a brass and a bronze coating. To produce a bronze electroplate a standard potassium cyanide copper tin electroplating bath is employed. The copper in the bath is about 30 gpl, the stannate is about 19 gpl, the potassium hydroxide is about 8.0 gpl, the potassium cyanide is about 35 gpl, and the potassium carbonate is less than about 280 gpl.

To produce a brass plated piece, a standard brass cyanide plating bath is used. The composition of an exemplary bath is: CuCN 26 gpl, ZnCN 11 gpl, KCN 45 gpl, and $K_2CO_3$ at 7.5 gpl. The blanks are plated at a current density of 0.35 A/dm$^2$ for 1 hours.

It is also possible, although not necessary, to anneal or heat treat the aluminum coated blanks after electroplating, rinsing, and drying, without damaging the electroplated surface. An improvement in adhesion might be achieved for some aluminum substrates or electroplates, within the scope of the present invention.

Electroplated coinage blanks produced by the above processes have been demonstrated strongly adhere to the aluminum substrate, with adhesion sufficient to withstand a deformation process such as minting, and to pass a standard bend test applied in the coinage industry.

Advantages

The two main categories of advantages of this invention relate to its suitability in producing a final product for the coinage industry, and in its ability to improve the manufacture of electroplated aluminum parts. In respect of producing a coinage product, there are four areas in which the process of the present invention provides major advantages to the production of electroplated aluminum coinage, these areas being cost, weight, mintability, and flexibility. The most important advantage of electroplated aluminum coinage is cost reduction on a per piece basis. By using aluminum as a substrate it is possible to eliminate annealing and burnishing, and the subsequent costs. Another area of cost reduction is in the punching step. For a given sized punch press, it is possible to punch strip that is substantially wider as compared to steel. This is a productivity improvement. The second advantage is that aluminum has a low density, and as a result, for a given sized coin, an aluminum substrate blank is significantly lighter. A further advantage of an electroplated aluminum blank is its mintability. It is possible to mint the electroplated aluminum blanks at much lower minting pressures than steel, and that leads to longer die life. Longer die life translates to lower minting costs for world mints. Furthermore, by the process of the present invention, it is possible to electroplate a wide variety of different coatings on aluminum making it a very flexible substrate.

Under the category of improving the manufacture of small electroplated aluminum parts, as emphasized above, the process of the present invention has been demonstrated to produce a highly adherent electroplate. With this process it is possible to produce parts at practical current densities for the barrel plating of aluminum parts. The invention has been demonstrated to withstand the rigors of deformation processes, including minting, and a coinage bend test. This advantage makes the process applicable to any electroplating application in which it is desired to improve the adherence of the electroplate to aluminum substrates. Finally, by reducing the critical current density required in the strike bath, the invention has enabled the production of electroplated parts at normal barrel electroplating production loads.

EXAMPLES

The present invention is illustrated in the following non-limiting examples, in which circulation coinage was made from cores of aluminum or aluminum alloy, whose surface was zinc-copper-nickel plated, zinc-copper plated, zinc-copper-bronze plated, and zinc-copper-brass plated (Examples 1 to 5). Examples 6, 7 and 8 provide comparative electroplating results when zincating baths of the prior art were unsuccessfully tested by the inventors.

Example 1

Electroplated Coinage with Copper Plate

Standard 5052 4' wide by 8' long by 0.0625" thick 5052 sheet was purchased from a vendor, and it was cut into 8"

widths. The 8" strip was fed into a Minster PM3-125 punch press to produce the cores for coating. The punch press uses a series of punches and dies arranged in a pattern to produce circular discs called blanks. The blanks had a diameter of 20.0 mm, and with a core thickness of 1.5 mm.

Following the punching operation, the blanks were rimmed using a standard EVD type coin rimming machine. The machine operates automatically where the blanks are fed into a grooved wheel using a vibratory feeder that controls the feed rate and segment that reduces the diameter and upsets a rim onto the blank. The rim height produced in the rimming operation was approximately 1.70 mm in height. After blanking, and rimming, the blanks were transferred to the pre-treatment and electroplating process.

One hundred aluminum or aluminum alloy blanks were loaded into a Sterling laboratory plating cylinder. The barrel had danglers that provided the electrical contact from the rectifier to the aluminum blanks. This barrel is commonly used in research and development in the electroplating industry. The barrel that was used measured 70 mm in length and 40 mm in diameter. On top of the barrel there was a small motor that provided rotation to the cylinder. Throughout the pre-treatment procedure, the blanks were transported in the cylinder sequentially from operation to operation. All of the solution in this process were contained in 30 liter plastic tanks.

Next, the blanks were treated to remove dirt, grit, and oils from the aluminum or aluminum alloy blanks through the use of an alkaline cleaner. The cleaning was performed for 5 minutes at a temperature of 60° C. The cleaner used in this example was Oakite Aluminum Cleaner 164 available from Oakite. This was followed by a two-stage rinse to remove any cleaner from the blank surface. Each rinse step was 2 minutes.

The blanks were then etched in a 50% nitric acid solution for 1 minute, using a bath temperature at room temperature. This step was a desmutting step to remove any surface grime from the preceding operation. A two-stage rinsing in deionized water was conducted after the acid step. Each rinse step was approximately 1 minute. The rinse was to eliminate any residual acid carry over into the next process step.

The next step in the pretreatment process was to zincate the blanks. The purpose of this step is to form a zinc-nickel-copper coating on the aluminum blanks. The zincating step is a metal displacement reaction where the aluminum oxide surface layer is removed, and then aluminum metal is substituted by zinc, copper and nickel on the surface. In accordance with the present invention, a two step zincating process was used to improve adhesion of the coating to the aluminum substrate over that achieved with a single zincating step.

In the first zincating step, the Sterling barrel loaded with the blanks was placed into a zincate bath with a composition of 273 gpl NaOH, 24 gpl $NiSO_4 6H_2O$, 8.7 gpl $CuSO_4 5H_2O$, 40 gpl $ZnSO_4$, 40 gpl $ZnSO_4 7H_2O$, and 1.7 gpl iron chloride and 0.25% Rexonic™ wetting agent. The temperature of this bath was maintained at 40° C., and the blanks were immersed in this bath for 1 minute. This step was followed by a two-stage rinse in deionized water for 2 minutes.

The first zincate layer was removed in nitric acid by immersing in a 50% nitric acid solution for 15 seconds at room temperature. The nitric acid strip was followed by a two step rinse in deionized water. The blanks were rinsed for two minutes in each step.

The blanks loaded in the Sterling barrel, for a second time, were then immersed in the zincate bath having the same composition as above, for 15 seconds. The second zincate step was followed by a two-step rinse in deionized water for 2 minutes each. The second zincating step provides a more adherent zinc layer.

Without removing the blanks from the barrel, they were then immersed in a low pH sodium or potassium cyanide copper strike bath. The pH of this bath was 8.5, the free cyanide was 15 gpl, the copper cyanide was 30 gpl. Adding tartaric acid to a standard copper cyanide strike solution reduces the pH of the strike bath from 11.0 to 8.5. The current density ranged between 0.10 $A/dm^2$ and the current was applied by a 100 volt rectifier upon entry into the electroplating bath. The blanks were plated in the strike for 12 minutes.

After the strike, the blanks were transferred into a standard potassium cyanide copper-electroplating bath. The copper concentration was 32 gpl. The free potassium cyanide concentration was 15 gpl, and the potassium hydroxide concentration was 15 gpl. The blanks were plated at a current density of 0.10 $A/dm^2$ for 5 hours.

After the blanks were removed from the final plating bath, the blanks were rinsed in deionized water. The blanks were rinsed in two separate rinses at 2 minutes each. This was followed by immersion in a citric acid solution for 5 seconds. Following removal from the citric acid solution with a pH of 5.5 to prevent staining of the copper surface, the blanks were removed from the plating barrel and then placed in a New Holland™ dryer for 5 minutes to remove any excess moisture from the surface of the blanks.

The final process was to test the mintability of the blanks. The blanks were minted in a Schuler horizontal minting press. The blanks were loaded into a bowl feeder, which fed the blanks into a single line along a guiding track. The minting finger transferred the blank into the collar where it was ready to be struck. The collar was positioned between two minting dies that contained the negatives of the design that was to be imparted to the coin. The minting dies were closed and plastically deformed the blanks in the collar, and the material on the blank flowed following the pattern engraved on the die to provide the surface relief to the coin. As the dies separated the coin was ejected.

Following minting, the blanks were found to be free of surface defects, and possessed full detail of the design on the minting dies. Additionally, the coins were brilliant in appearance, and there was no transfer of the electroplated coating to the minting dies. Finally, there were no signs of material flow patterns such as striations in the minted relief indicating that the blank has the requisite properties to be minted. Additionally, the minted blanks had a bright and shiny appearance indicating that there was no need for any post electroplating finishing processes.

Following plating, the blanks were subjected to a bend test and hacksaw test to assess the adhesion of the electroplated layer to the aluminum substrate. After the bend test, the plate was cracked, but was still strongly adhered to the aluminum as it could not be picked off by a sharp object. This indicates strong adhesion as referenced by ASTM standard B571-91 Standard Test Methods for Adhesion of Metallic Coatings. Under section 3.1, referred to as Bend Tests of the Standard, "cracks are not indicative of poor adhesion unless the coating can been peeled back with a sharp instrument." Additionally, the blanks were cut with a hack saw, and the coating was still strongly adhered to the aluminum substrate. As another benchmark of adhesion, bond tests of the coating were performed to assess the strength of the bond between the electroplate and the aluminum substrate. The bond tests were performed by gluing a jug onto the plated surface and placing the sample into a tensile machine. The glue failed on the copper-plated blank at 2,000 psi indicating that the strength of the bond between the copper and the aluminum substrate was actually higher than 2,000 psi.

Copper coated blanks were annealed in a hydrogen reducing atmosphere at 220° C. for one hour. The blanks were minted, and the visual appearance was consistent with the results achieved in blanks that were not annealed. The annealed and minted coin blanks were also subjected to the bend test, and the coating was completely coherent along the outside edge of the bend.

Example 2

Modified Copper Electroplating Bath

This example demonstrates the use of the two step zincating, copper strike, and copper electroplating bath for the purposes of a "bright" electroplating bath. Unless otherwise set out, the process of Example 1 was followed.

The edged aluminum blanks were prepared and followed a similar zincating process to that of Example 1. After the zincating, the blanks were immersed into the low pH sodium cyanide strike solution of Example 1, but having a pH of 9.0, free cyanide of 23 gpl, and copper in solution of 30 gpl. The zincated blanks were immersed in this strike bath for 15 minutes.

The next step was to electroplate the final copper plating layer onto the blanks with the copper strike. The copper concentration in the electroplating bath was 25.5 gpl. The free potassium cyanide concentration was 10.2 gpl. Additionally, the bath contained 0.3% volume Atotech addition agent CL-3, and 0.5% Atotech addition agent CL-4. These addition agents were brighteners purchased through Atotech Canada Ltd. of Burlington, Ontario, Canada.

Following plating, the blanks were subjected to a bend test and hacksaw test to assess the plate adhesion. After the bend test, the electroplate was completely coherent along the bend. As there was no evidence of peeling or flaking, strong adhesion was achieved. This is in accordance with the bend test standard of ASTM B571-91, as referenced in Example 1. Additionally, the blanks were cut with a hack-saw, and the plate was still strongly adhered to the aluminum substrate because it could not be peeled from the edges where the plated blank had been cut.

Example 3

Nickel Plated Aluminum Blanks

This example demonstrates the process of this invention with nickel plated aluminum coinage blanks. A similar blank preparation process was used as in Example 1 except for the final plating step. After the cooper strike, the blanks were immersed in a nickel sulphamate electroplating bath. The pH of the nickel plating bath was 2.35, the boric acid concentration was 42.2 gpl, the surface tension was 37.6 dynes/$cm^2$, and the nickel concentration was 113 gpl.

The blanks were plated for three hours in the nickel sulphamate plating bath. The blanks were then rinsed in two separate rinses for 2 minutes each and then minted in a similar fashion to Example 1. The adhesion of the coating was tested with a 90° bend test. The coating cracked along the outside radius of the bend; however, it would not be peeled from the surface using a sharp object. According to ASTM Standard B 571-91, as referred to in Example 1, this indicates that there was strong adhesion of the nickel coating to the aluminum substrate. A bond test was also performed on the nickel-plated aluminum blanks. The same procedure was used in Example 1 for the bond test. In this experiment, the glue failed at 6,000 psi indicating very strong adhesion of the nickel layer to the aluminum substrate.

Example 4

Bronze Plated Aluminum Blanks

Yellow colored coins are widely used throughout the world. In this example, bronze plated blanks were produced. Following the same blank production process as Example 1, except that a current density on the copper strike was 0.25 A/$dm^2$. After the strike, the blanks were plated with bronze to produce a golden colored blank. The bronze electroplating bath was a standard potassium cyanide copper tin electroplating bath. The copper in the bath was 30 gpl, the stannate was 19 gpl, the potassium hydroxide was 8.0 gpl, the potassium cyanide was 35 gpl, and the potassium carbonate was less than 280 gpl.

Following the electroplating bath, the blanks were rinsed in deionized water in two separate steps for 2 minutes each, and then dried similarly to Example 1. The blanks were minted, as in Example 1, and their surface appearance was assessed.

Example 5

Brass Plated Aluminum Blanks

Brass is another yellow colored alloy that is widely used in coinage. The process followed the same blank preparation procedure as Example 1. Following the low-current density copper strike, the blanks were plated with brass in a brass-cyanide electroplating bath. The composition of the bath was CuCN 26 gpl, ZnCN 11 gpl, KCN 45 gpl, and $K_2CO_3$ at 7.5 gpl.

After electroplating, the blanks were rinsed in deionized water in two separate steps for 2 minutes each, and then dried for 5 minutes in the New Holland drier to remove any moisture. The blanks were then minted similarly to Example 1, and their visual appearance was found to be suitable for circulation coinage.

Example 6

Comparative Example with Prior Art Simple Zincating Solution

This example demonstrates that a simple zincating solution could not be used to produce circulation coinage which passed the required adhesion tests. Type 5052 aluminum alloy blanks were punched and rimmed according to the procedure of Example 1. The blanks were loaded into the standard electroplating barrel of Example 1. Pretreatment included an alkaline cleaning step at 60° C. for 3 minutes followed by a two-stage rinse similar to example 1. This was followed by nitric acid desmut step for 1 minute. The concentration of the nitric acid was 50%, and the temperature was at room temperature. This was followed by a two-stage rinse similar to Example 1.

The next step was to zincate the blanks using a simple zincating solution. The composition of the zincate bath was ZnO 100 gpl, NaOH 525 gpl, $FeCl_3$ 1 gpl, and potassium sodium tartrate 10 gpl, at room temperature. The blanks were immersed for 3 minutes and then rinsed in deionized water in two separate steps for one minute each. The first zinc coating was then removed by nitric acid immersion at room temperature for 15 seconds. After rinsing, the blanks were then immersed in the same zincate solution for 30 seconds, and then rinsed.

After rinsing, the aluminum blanks were moved into a standard copper strike solution. Both live-entry, or the application of current prior to immersion into the plating bath were tested. The bath chemistry was similar to example 1; however, the pH of the bath was 11.0. The current density was 2.5 A/dm$^2$ for 2 minutes, and then dropped to 1.25 A/dm$^2$ for 3 minutes. Copper plating followed the copper strike, using a copper plating bath as set out in Example 1.

After removal from the copper plating bath, rinsing, and drying, the blanks were subjected to the bend test. Along the external side of the bend blank, the coating was cracked. The ASTM Standard B 571-91 referenced in Example 1 states that "If the coating fractures, or blisters, a sharp blade may be used to attempt to lift off the coating . . . Cracks are not indicative of poor adhesion unless the coating can be peeled back by a sharp instrument." The electrodeposited copper coating broke, and could be peeled from the surface of the aluminum blank using the fingers, showing that the samples did not have acceptable adherence of the electroplate on the aluminum substrate.

Example 7

Comparative Example with Prior Art MAZ Zincating Step

Using the standard cleaning, and acid etch pre-treatment for the blanks as in Example 1, the blanks were subjected to double zincating using the MAZ solution. A typical MAZ solution from British Patent 1,007,252 was assessed to determine if it meets the requirements for coinage. This solution has a concentration of NaOH of 106 gpl, zinc sulfate 40 gpl, nickel sulfate hexahydrate 30 gpl, zinc sulfate heptahydrate 40 gpl, potassium hydrogen tartrate 50 gpl, and copper sulfate pentahydrate.

The next step was to perform a copper strike using a standard copper strike solution. The copper strike contained 30 gpl of copper, 45 gpl of NaCN, 5 gpl free sodium cyanide, and a pH of 10.5. The next step was to copper plate using the same copper plating solution as Example 1. This solution did provide improved adhesion over the "simple" zincate solutions. Nevertheless, it was still inadequate for circulation coinage purposes. After the bend test, there was peeling of the coating along the edge and rim of the blank, and it was possible to peel the coating off using the fingers.

Example 8

Comparative Example with Prior Art Substar™ Zincating Step

Japanese patent document 5035963 discusses the game machine coins and their manufacture. In this example, it was attempted to produce coinage blanks using a similar process discussed in that patent document.

The aluminum blanks were prepared using similar punching, and edging processes as discussed in Example 1 above. The next step was to alkaline etch in 10% sodium hydroxide aqueous solution at 60° C. for 1 minute. After this step, the blanks were rinsed in a two-stage rinse for 1 minute each. Following the washing process, the zincate treatment was applied using 500 ml/l Substar ZN-111 from Okuno Reagent Industry at 22° C. for 1 minute to coat it with zinc.

The blanks were rinsed and placed into the copper strike used in the Example 3. The strike current density was 2.5 A/dm$^2$. This is within the range of 2 to 10 A/dm$^2$ recommended by the authors of the JP document. Following the strike, the blanks were then plated for 1 hour at a current density of 0.25 A/dm$^2$.

After drying, a bend test was performed on the blanks. This test is not referred to in the Japanese document. The bend test failed. The copper coating split from the surface of the blanks and it could be peeled off very easily, and thus was unacceptable for circulation coinage.

All publications mentioned in this specification are indicative of the level of skill of those skilled in the art to which this invention pertains. All publications are herein incorporated by reference to the same extend as if each individual publication was specifically and individually indicated to be incorporated by reference.

The terms and expressions in this specification are used as terms of description and not of limitation. There is no intention, in using such terms and expression of excluding equivalents of the features shown and described, it being recognized that the scope of the invention is defined and limited only by the claims which follow.

We claim:

1. An electroplated aluminum part or strip, comprising:

a substrate formed from aluminum or an aluminum alloy and having multiple surfaces;

a layer of zincate completely encasing the substrate;

a strike layer of a strike metal covering the layer of zincate; and one or more electroplated layers of one or more metals covering the strike layer, said one or more electroplated layers adhering to the substrate to withstand a bend test in accordance with ASTM standard B571-91, wherein the electroplated substrate is bent through a 90° angle and the one or more electroplated layers are not removable with a sharp blade.

2. The electroplated aluminum part as set forth in claim 1, wherein the substrate is a coin blank and wherein the one or more electroplated layers is composed of one or more coinage metals or alloys selected from the group consisting of nickel, copper, bronze, brass, silver, gold, platinum and alloys thereof.

3. The electroplated aluminum part as set forth in claim 2, wherein the layer of zincate comprises zinc, nickel, copper and iron.

4. The electroplated aluminum part as set forth in claim 3, wherein the strike layer is of copper or nickel.

5. The electroplated aluminum part as set forth in claim 4, wherein the one or more electroplated layers adhere to the substrate sufficient to withstand minting step comprising striking the plated coin blank to create an impression having 0.02 to 5 mm relief detail.

6. The electroplated part as set forth in claim 5, wherein the coin blank is formed from an aluminum alloy selected from the group consisting of 1XXX, 3XXX or 5XXX series of wrought aluminum alloys.

7. The electroplated part as set forth in claim 5, wherein the coin blank is formed from an aluminum alloy selected from the group consisting of 1100, 3003, 3105, 5052, and 5056 aluminum alloys.

8. The electroplated part as set forth in claim 5, 6 or 7, wherein the coin blank has been minted after electroplating.

* * * * *